US006829916B1

(12) United States Patent
Devecki

(10) Patent No.: US 6,829,916 B1
(45) Date of Patent: Dec. 14, 2004

(54) SCUBA TANK LOCK

(76) Inventor: Ron Devecki, 2674 Kirk Rd., West Palm Beach, FL (US) 33406

( * ) Notice: Subject to any disclaimer, the term of this patent is extended or adjusted under 35 U.S.C. 154(b) by 0 days.

(21) Appl. No.: 10/666,186

(22) Filed: Sep. 17, 2003

(51) Int. Cl.[7] ..... E05B 73/00
(52) U.S. Cl. ..... 70/18; 70/58
(58) Field of Search ..... 70/14, 18, 30, 70/49, 58, 233; 248/551–553

(56) References Cited

U.S. PATENT DOCUMENTS

| | | | | | |
|---|---|---|---|---|---|
| 1,274,203 | A | * | 7/1918 | Sager et al. | 211/4 |
| 3,101,695 | A | * | 8/1963 | Honeyman, Jr. | 114/230.29 |
| 3,841,118 | A | | 10/1974 | Stone | 70/33 |
| 3,859,826 | A | * | 1/1975 | Singer et al. | 70/58 |
| 3,987,653 | A | | 10/1976 | Lyon et al. | 70/19 |
| 4,003,228 | A | * | 1/1977 | Lievens et al. | 70/58 |
| 4,055,973 | A | | 11/1977 | Best | 70/58 |
| 4,212,175 | A | | 7/1980 | Zakow | 70/58 |
| 4,570,465 | A | * | 2/1986 | Bennett | 70/18 |
| 4,573,584 | A | * | 3/1986 | Otema | 211/4 |
| 4,598,827 | A | | 7/1986 | Keifer | 211/4 |
| 4,733,840 | A | * | 3/1988 | D'Amore | 248/205.3 |
| 4,979,382 | A | * | 12/1990 | Perry | 70/58 |
| 5,154,072 | A | | 10/1992 | Leyden | 70/18 |
| 5,351,507 | A | * | 10/1994 | Derman | 70/18 |
| 5,398,530 | A | * | 3/1995 | Derman | 70/58 |
| 5,481,888 | A | * | 1/1996 | Perry | 70/18 |
| 6,003,348 | A | | 12/1999 | McCrea | 70/18 |
| 6,167,734 | B1 | * | 1/2001 | Derman | 70/18 |
| 6,212,919 | B1 | | 4/2001 | Gerow | 70/18 |

* cited by examiner

*Primary Examiner*—Lloyd A. Gall
(74) *Attorney, Agent, or Firm*—McHale & Slavin PA

(57) ABSTRACT

An accessory locking device for use in combination with a steel cable lock. The locking device is formed from a steel plate having an aperture and an L-shaped slot depending therefrom, the aperture is sized to receive the steel cable lock. The locking device further includes a flexible attachment cable having one end permanently attached to the steel plate and a distal end having an end fitting swaged thereto. The end fitting may be sized for insertion through the aperture and the flexible cable is sized for placement within the L-shaped slot of the steel plate. In operation, the distal end of the flexible attachment cable is wrapped around a diving accessory, such as a scuba tank, and the flexible cable is transversed into the L-shaped slot leaving the aperture available for the flexible steel cable lock to secure the locking plate, and the diving accessory, to a fixed object to prevent theft.

11 Claims, 3 Drawing Sheets

SCUBA TANK LOCK

FIELD OF THE INVENTION

The invention relates to locking devices and more particularly to a locking device for use with diving equipment.

BACKGROUND OF THE INVENTION

Recreational and professional scuba divers require numerous accessories for underwater exploring and/or work. The accessories include air tanks, weights, buoyancy compensators, computors, wet suits, float balls/flags, and so forth. All such accessories are necessary for a safe dive and typically consist of the latest in technology. Thus, even if older equipment is used it is meticulously maintained since any failures could result in injury or death. For this reason, most any accessory used in diving is very expensive and, due to the portability of the profession, easily transported.

While many of the accessories can be hidden from the view of a potential thief, some of the accessories are impractical to conceal due to size, weight, space considerations or the inherent dangers associated with concealing some of the items. For instance, scuba tanks are commonly left on the deck of a boat due to problems in storage. Since scuba tanks are expensive and easily moved they make for easy prey by thieves.

Scuba tanks may be left on a deck of a boat due to lack of storage space but more commonly are left on the deck due to dangers associated with attempting to conceal scuba tanks. Scuba tanks are very heavy, weighing approximately 40 pounds when fully charged and contain 3000 pounds per square inch of compressed air. At the upper end of a scuba tank there is a K-valve that should it be broken off, the compressed air would project the K-valve flying at a velocity sufficient to cause death or serious injury to a person struck by it. Consequently, tanks are typically stored in the vertical position in the cockpit of a boat in a holder commonly referred to as a tank rack.

The amount of compressed air utilized by a scuba diver in the course of his underwater activities depends on the depth at which he is diving; greater amounts of air are utilized at greater depths. However, on the average, a diver will utilize a full tank of air in 30–40 minutes. For this reason, a diver will typically employ at least two tanks for any diving expedition. Since it is most unsafe to dive alone, a diver typically travels with at least one other diver which results in at least four scuba tanks that could be stolen if unattended.

There are various known tank racks that are designed to secure a particular size tank and may include provisions for locking of the scuba tanks. The following patents provide examples of scuba tank racks: U.S. Pat. Nos. 3,791,403; 2,122,897; 3,193,778; 3,860,048; 3,693,830; and 1,174,185.

In addition, cable locking devices are known in the art. For instance Stone, U.S. Pat. No. 3,841,118 discloses a cable lock designed to facilitate locking motorcycles, bicycles, snowmobiles and outboard motors to a post or tree to prevent theft. The cable lock includes an elongated cable and a pair of mating block sections with means for securely locking the same around the cable to form a positively locked loop.

McCrea, U.S. Pat. No. 6,003,348, discloses a cable lock for surfboards. A sleeve fitting is swaged to a length of cable such that a loop is formed at the end of cable. This loop is used to secure the cable to a rack or other stationary component. A block is used to retain the cable around the object itself. The cable passes through a hole in one end of the block, wraps around the object, and slides into a slot in the other end of the block. An end fitting swaged to the cable prevents the cable from sliding out of the slot in a parallel direction. A padlock is used to prevent the cable from sliding out of the slot in a perpendicular direction. A setscrew is used to retain the block to the cable in the desired location.

Lyon et al, U.S. Pat. No. 3,987,653, disclose a locking device for a looped cable which includes a casing in which one end of the cable is anchored and a passageway through the casing through which the other end of the cable can be passed. Within the casing is a cable clamp for reducing the size of the passageway, the clamp being threaded on a screw and movable to change the size of the passageway by rotation of the screw. The screw is rotatable by rotation of a lock mounted in the casing, the lock being rotatable by a key. The clamp cooperates with a bed to define the passageway, the clamp and bed having intercalated pyramidal teeth which can exert a vise-like grip on a cable of normally cylindrical shape.

Gerow, U.S. Pat. No. 6,212,919, discloses an adjustable cable loop locking system for securing two spaced apart articles, such as a boat to dock piling, with a length of flexible cable. The system includes first and second mechanisms slidably disposed on opposite end portions of a cable in which are formed first and second cable loops respectively. A flexible sheath, which may be a conventional hollow hydraulic hose, slidably covers a central portion of cable and is affixed on opposite ends thereof to the first and second mechanisms to fix the distance between the mechanism as measured along the central portion of the cable. The two lead-in portions of the first loop slidably extend through the first mechanism except that one of these lead-in portions which contains a free end of the cable can be selectively locked in a stationary position in the first mechanism by operation of a locking handle when desired. One of the lead-in portions of the second loop which extends from the first mechanism extends slidably through the second mechanism to the second loop, the end of the cable at the end of the second loop being fastened in the second mechanism. The arrangement permits securing two spaced apart articles together while needing to lock only the first of the two mechanisms.

Zakow, U.S. Pat. No. 4,212,175, discloses a lock for items of portable personal property. The lock includes a plurality of cables extending from a locking box which is mountable to a mounting surface. The items of personal property are mounted to the cables, and at least one end of each cable is secured to one of a plurality of nipples disposed within the box. The locking box has an inner box member and an outer box member which are matable to form the box; the width of the opposed side walls of both the inner box member and the outer box member are generally equal, so that jimmying, or forced opening of the box is precluded since the free edges of the side walls of the outer box member are contiguous with the fixed planar surface when the assembled box is mounted to the surface.

Best, U.S. Pat. No. 4,055,973, discloses an equipment lock for laboratory or office equipment and the like. To prevent removal of the items, separate cables are attached to four or more items of such equipment and have circumferentially-grooved end members which are received in separate bores in a single lock body and are locked therein by a key-controlled keeper. The keeper is a key-removable core inserted in a core chamber which partially intersects the cable-receiving bores, so that the core itself engages in the grooves of the cable end members to lock them against retraction. A mounting screw access passage traverses the core chamber, and is blocked by the core in such chamber to prevent access to a mounting screw inserted through such passage.

Leyden, U.S. Pat. No. 5,154,072, discloses a cable lock for securing a plurality of cables having a blocking shoulders on the ends. The cable lock has openings dimensioned to receive the cable shoulders. A cover is mounted for selective movement relative to the housing between a position permitting passage of the cable through the opening to a position preventing passage of the cable through the opening. The housing is secured with a key operated tumbler lock.

Keifer, U.S. Pat. No. 4,598,827, discloses a system for securing display items to a fixture or the like comprising a housing adapted to be secured to the fixture and a plurality of elongated cables for securing the display items to the fixture. Each cable has a means at one end for securing it to the display item and is detachably secured in the housing at its opposite end. The housing includes cable retention and release channels for a plurality of cables. The channels have an enlarged entrance portion and are configured to permit insertion and removal of the opposite ends of the cables so that any one of the cables may be inserted or removed individually. The housing includes a locking means blocking the entrance portion of the channels and a second position permitting removal of the cables.

However, what is lacking in the art is the ability to securely lock single, or a plurality, of scuba tanks to most any tank rack or fixed object as well as secure various accessories.

SUMMARY OF THE INVENTION

Briefly described, and in accordance with one embodiment thereof, the invention provides a scuba tank locking device formed from a lock plate having an aperture with a slot extending therefrom. A flexible cable having a distal end is permanently attached to the lock plate with a distal end available for wrapping around the component to be locked. The flexible cable includes a line crimp that engages the slot. The aperture is then available for receipt of a larger cable lock that secures the lock plate, and the attached accessory, to a fixed object.

It is an objective of the invention to provide an inexpensive, durable, reliable, and portable means of locking scuba tanks.

It is another objective of the invention to provide a locking device which can conveniently lock scuba tank accessories such as weights, regulators, gauge units, buoyancy compensators, and the like accessories.

It is another objective of the invention to provide a locking device wherein scuba tanks can be securely locked without the necessity of making precise tank positioning adjustments.

Still another objective of the invention is to provide a scuba lock system that can quickly and safely secure scuba tanks and gear, either on the dock, in a vehicle, or anywhere that opportunistic theft is a possibility.

Another objective of the invention is to provide a locking device that can lock scuba tanks of various heights and diameters.

Other objectives and advantages of this invention will become apparent from the following description taken in conjunction with the accompanying drawings wherein are set forth, by way of illustration and example, certain embodiments of this invention. The drawings constitute a part of this specification and include, exemplary embodiments of the present invention and illustrate various objects and features thereof.

DRAWINGS

DETAILED DESCRIPTION

Although the invention will be described in terms of a specific embodiment, it will be readily apparent to those skilled in this art that various modifications, rearrangements and substitutions can be made without departing from the spirit of the invention. The scope of the invention is defined by the claims appended hereto.

Figure 1:
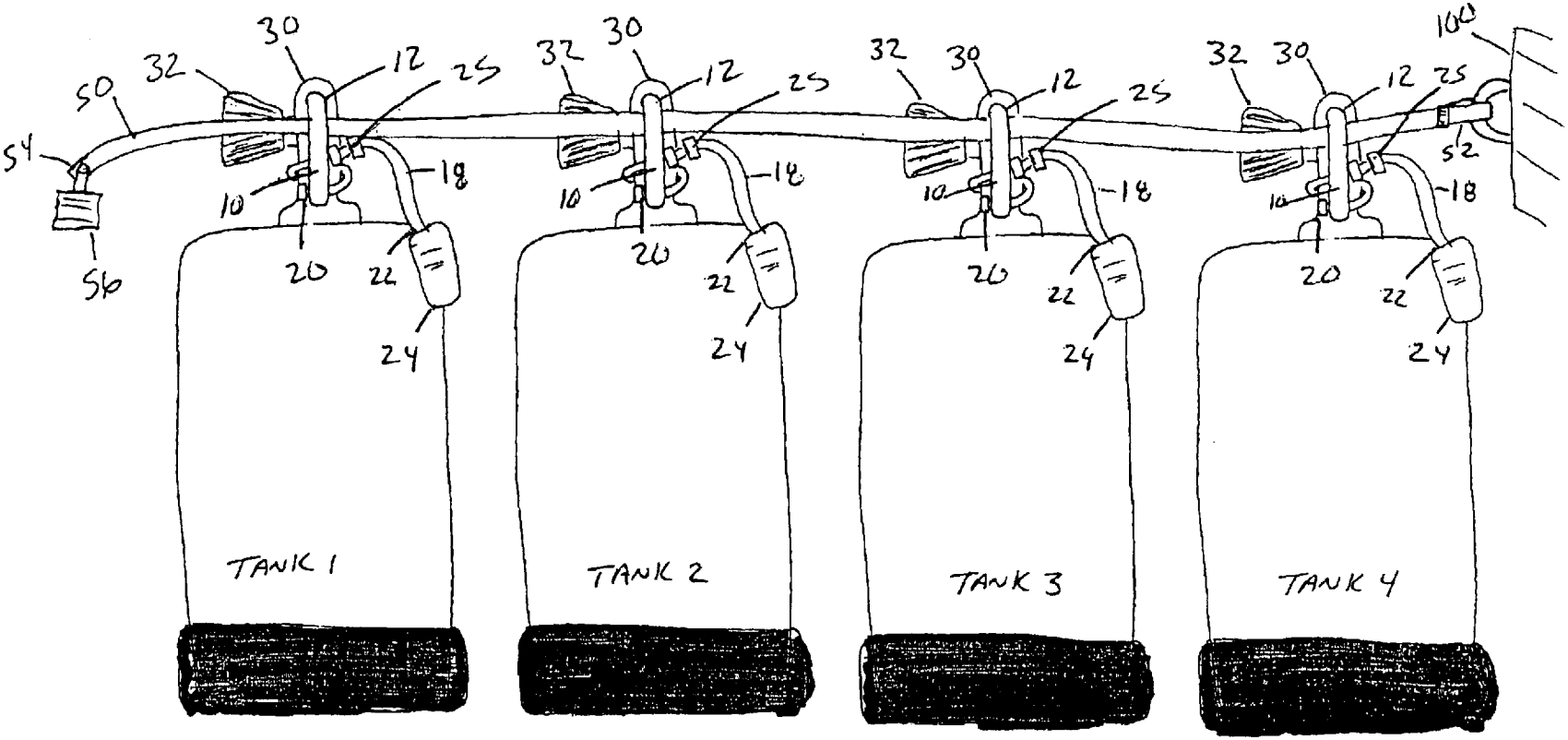
FIG. 1 is a pictorial view of four scuba tanks having the locking device of the instant invention secured to each tank and further secured to a fixed structure.

Now referring to FIG. 1, depicted are multiple scuba tanks 1–4 each having a locking device 10 placed in position for securing the tanks to a fixed structure 100. The locking device is formed from a steel lock plate 12 having a flexible attachment cable 18. One end 20 of the cable 18 is preferably permanently attached to the steel plate 12 and a distal end 22 having an end fitting 24 swaged thereto. The end fitting 24 may be sized for insertion through an aperture 14 in the steel plate 12 or permanently inserted therethrough with the end fitting enlarged to operate as a pull handle 24'. Multiple cable crimps 25 are used to provide locking of the flexible cable 18 at predetermined positions. When at least two cable crimps 25 are used, the cable 18 will be fixed to prevent lengthening as well as shortening of the cable. This is important when securing diving accessories where movement of the flexible 18 may otherwise provide a thief with the ability to dislodge an accessory. The steel lock plate 12 and flexible cable engage a K-valve 30 and further couple to a conventional lock cable 50 having a first end attachment end 52 that is secured to the fixed structure 100 and a second end insertion end having a transversely placed aperture receptive to the shank of a padlock 54 that passes through the steel plate 12 thereby preventing removal of the flexible cable 18. A lock 56 is secured to the second end thereby locking all of the tanks to the fixed structure.

The scuba tanks consist of cylinders housing compressed air, argon, helium, nitrogen or a mix of thereof. Scuba tanks are available in several standard sizes, the larger of which is an 120 cubic foot capacity tank, 7 and ¼ inches in diameter, and approximately 26 inches high. The most common tank is 80 cubic foot having slightly smaller dimensions. At the upper end of a scuba tank there is a valve commonly called a K-valve 30. The K-valve include a rotatable knob 32 for controlling the release of gas from the tank. The K-valve is subsequently coupled to a hose and air regular that allows the diver to breath underwater is common between the various size tanks. Thus, by providing a lock plate common to the K-valve, tanks of various sizes can all be locked with the same device.

Figure 2:
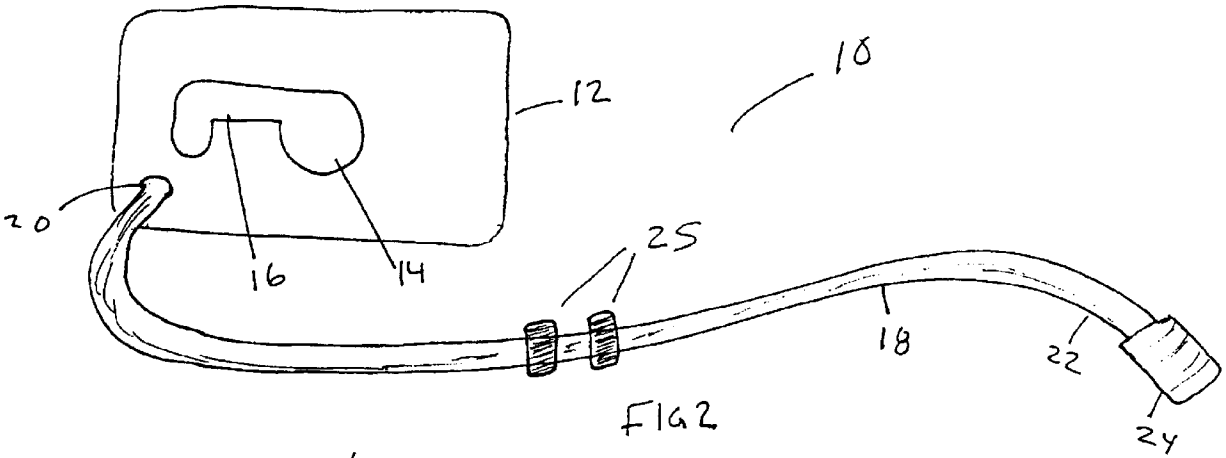
FIG. 2 is a perspective view of an embodiment of the scuba tank locking device without a handle.

FIG. 2 illustrates one embodiment of the locking device 10 which is formed from a substantially square or rectangular steel plate 12 having an aperture 14 and a slot 16 depending therefrom. The aperture 14 is sized to receive a flexible steel cable lock 50. The locking device 10 further includes a flexible attachment cable 18 having one end 20 permanently attached to the steel plate 12 and a distal end 22 having an end fitting 24 swaged thereto. In this embodiment the end fitting 24 is sized for insertion through the aperture 14. The flexible cable 18 is sized for placement within the slot 16 of the steel plate 12 and employs at least one cable crimp 25 which operates as a line positioner. However, multiple cable crimps 25 can be used to provide locking of the line at any number of positions and, when at least two cable crimps 25 are used, as shown, the cable can be fixed in length to prevent lengthening as well as shortening of the flexible attachment cable once placed in the slot. It should be noted that the proximal end 20 may be unattached wherein the flexible attachment cable 18 may be stored independently from the steel plate lock and when use is required, engage the proximal end 20 with the slot 16. In addition, it is possible to use this embodiment wherein the lock can be used independently from the main locking cable 50. The use of the smaller lug 24 can be passed through an object that might not be secured by a standard loop as described later in this patent. This would allow the cable to be used to lock wherein the steel plate lock can be secured by placement of a regular paddle lock though aperture 14. The loop can secure various items in the dive industry such as the regulator and groups of other equipment too small for a conventional type loop system. However, the preferred mode is to permanently attach the proximal end 20 of the flexible attachment cable to prevent loss of the component parts and make it convenient for installation.

Figure 3:
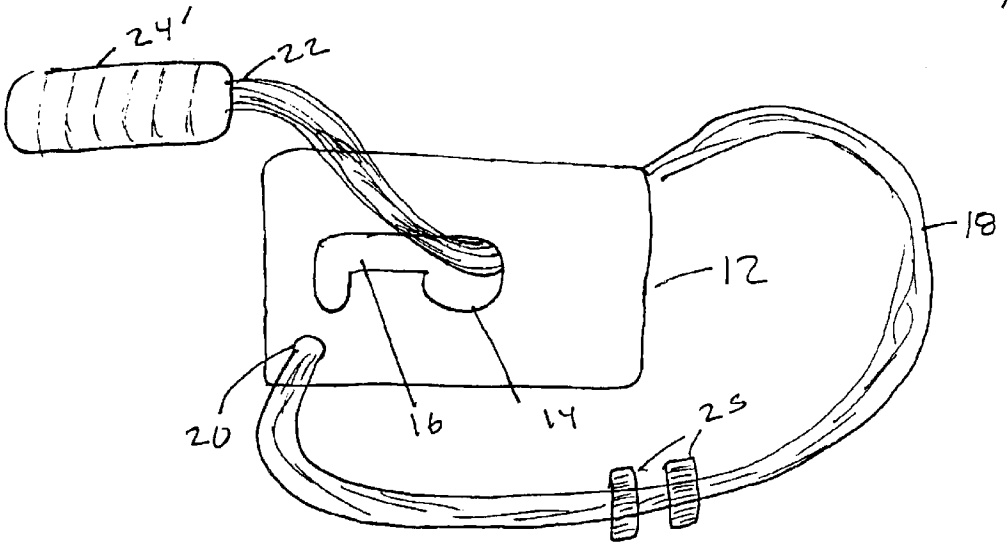
FIG. 3 is a front perspective view of an embodiment of the scuba tank locking device with a handle.
Figure 5:
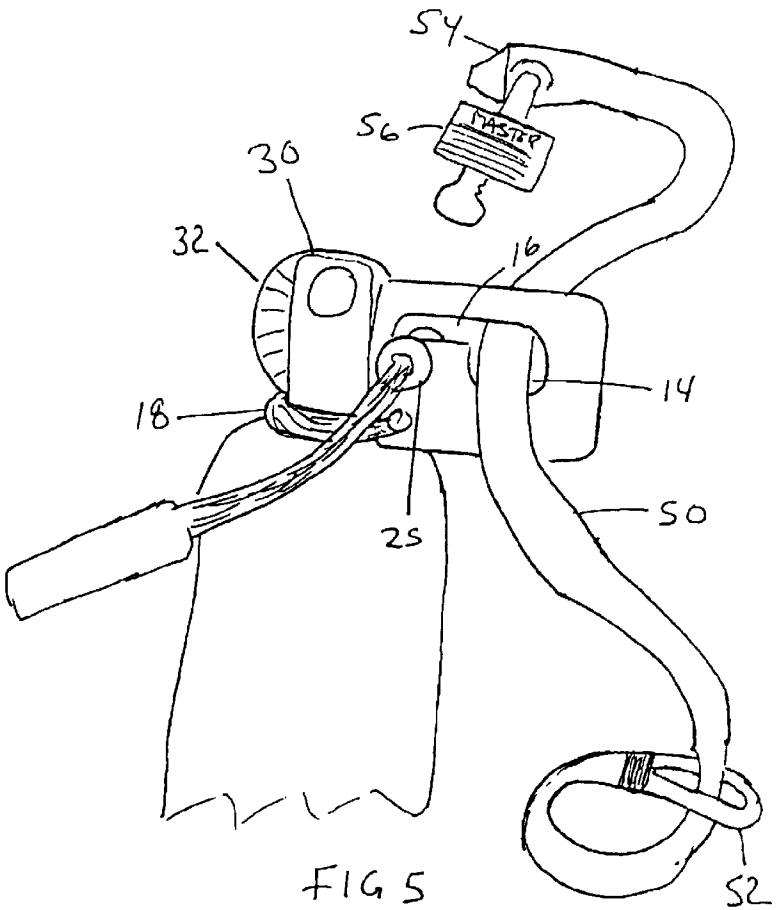
FIG. 5 is a side view of the locking device with handle secured to a scuba tank.
Figure 4:
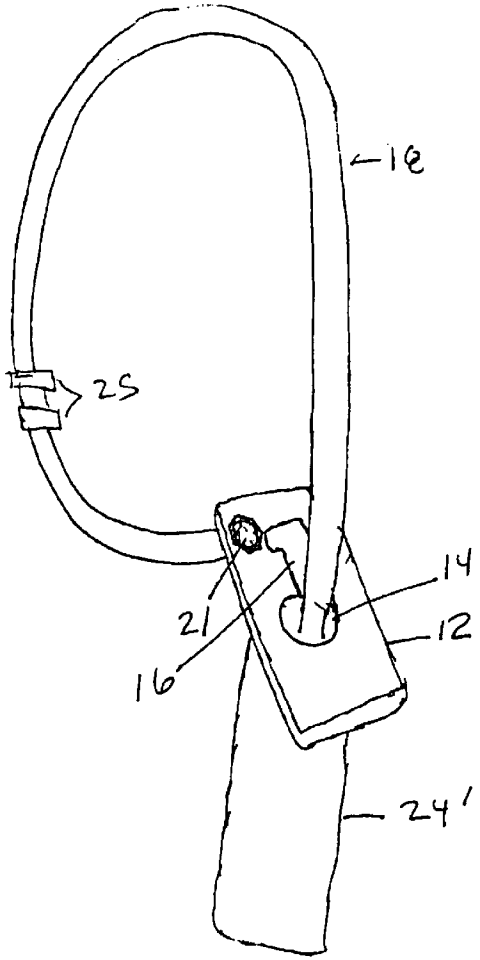
FIG. 4 is a rear perspective view of FIG. 3 an embodiment of the scuba tank locking device with a handle.
Figure 1:
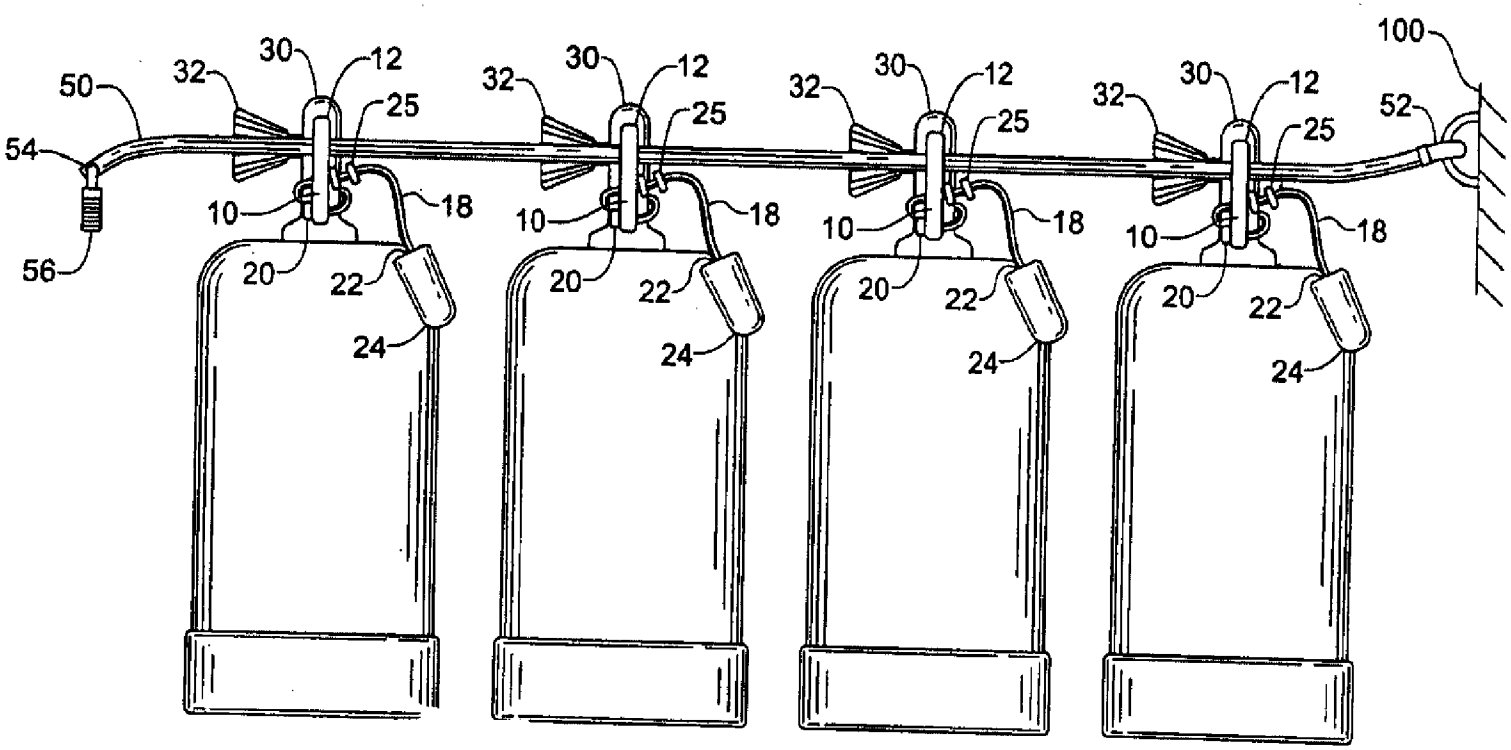
Figure 2:
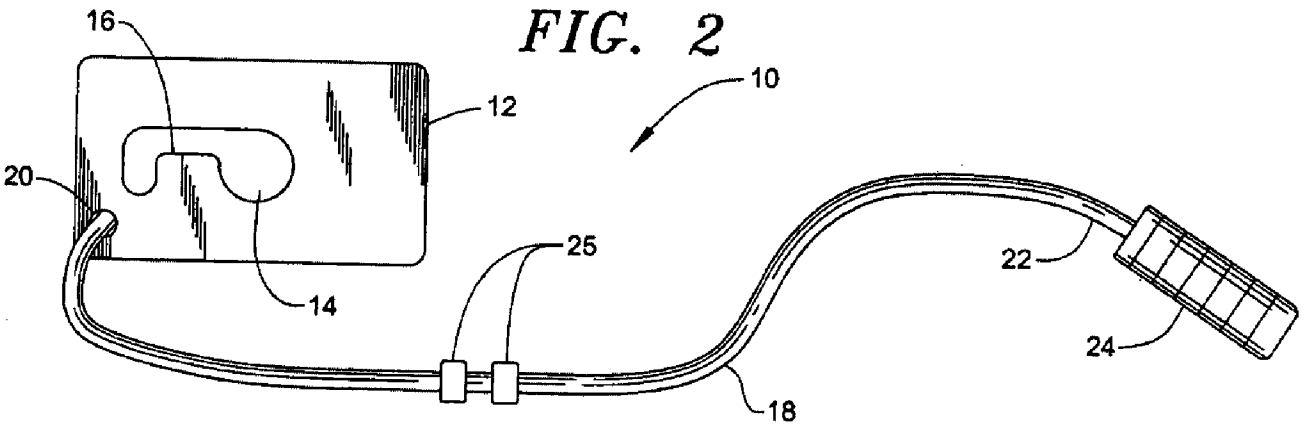
Figure 3:
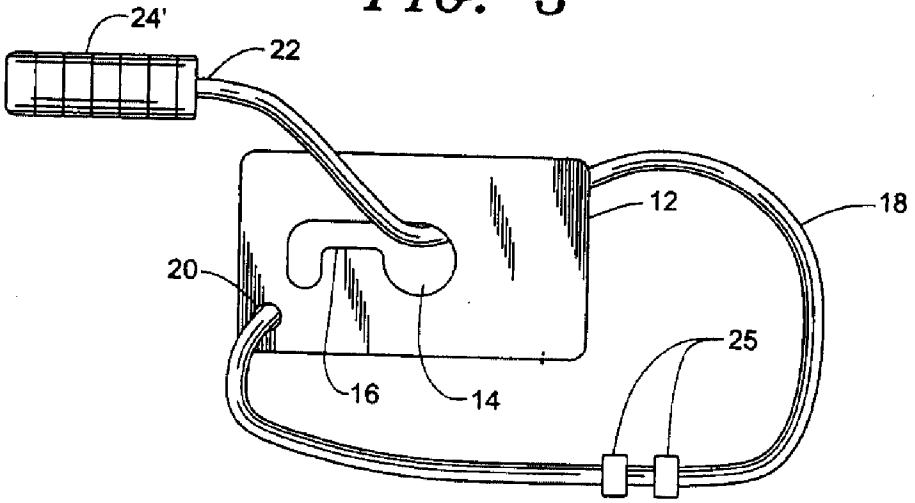
Figure 5:
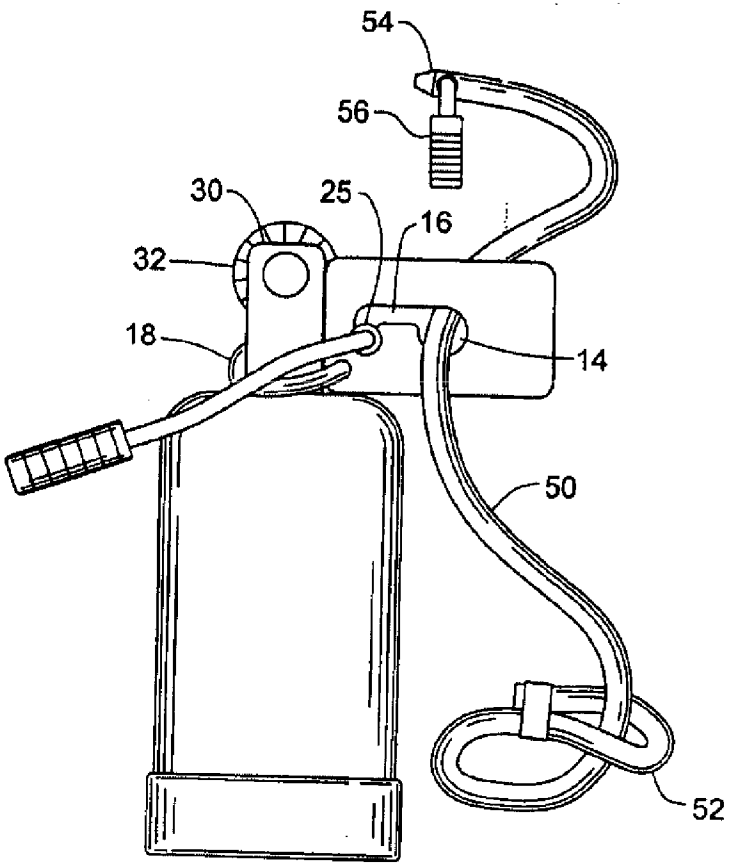
Figure 4:
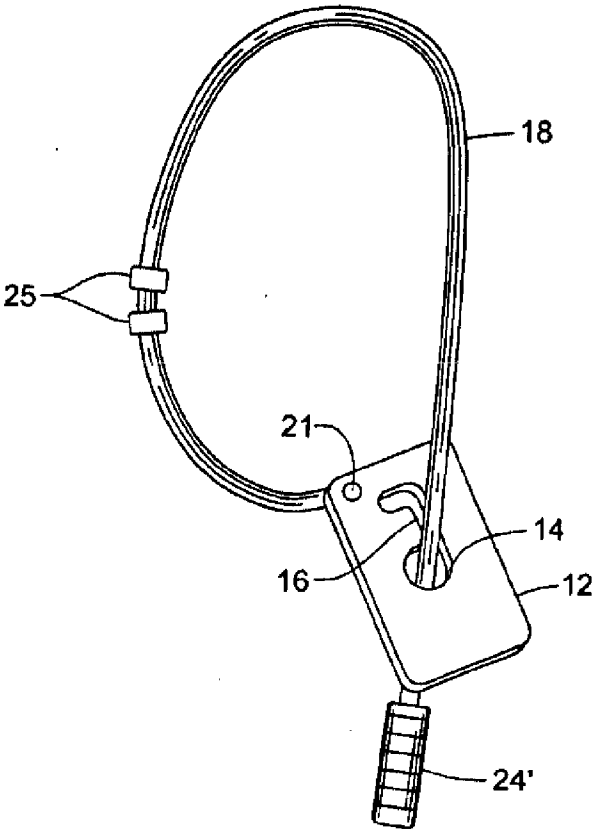

Now referring to FIGS. 3–5, the preferred embodiment of the locking device 10 is depicted. The locking device is formed from a substantially square or rectangular steel plate 12 having an aperture 14 and a slot 16 depending therefrom. The aperture 14 is sized to receive a flexible steel cable lock 50. The locking device 10 further includes a flexible attachment cable 18 having one end 20 permanently attached to the steel plate 12 and a distal end 22 having an end fitting 24 swaged thereto. End 20 can be either welded to the plate or employ a swage fitting 21 which would prevent the end 20 from pulling through the plate. In this embodiment the end fitting 24' is permanently inserted through the aperture 14 and is enlarged to operate as a handle. The flexible cable 18 is sized for placement within the slot 16 of the steel plate 12 and employs the crimps 25 to operate as a line positioner. Preferably the slot 16 is L-shaped making it easier to maintain the flexible cable 18 in position while the cable lock 50 is placed through the aperture 14.

In operation, the flexible attachment cable 18 is wrapped around the K-valve 30 and gas handle 32 of a scuba tank. At least one crimp 25 is drawn through the aperture 14 and then the cable 18 is transversed into the slot 16, leaving the aperture 14 available for the cable lock 50.

The flexible cable 18 is unable to reenter the aperture 14 due to the cable lock 50. The cable lock 50 is passed through the aperture of one or multiple lock plates 12 in a consecutive order until one or all the tanks are locked. If no fixed object is available, the locking of a plurality of tanks, (i.e. four or more) would prevent theft of the tanks since multiple tanks could be most difficult for a theft to lift or conceal. As this device can be used to lock an entire chain of tanks, such as those found on a dive boat, it is simple to lock the tanks together to deter theft.

It is to be understood that while I have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What is claim is:

1. An accessory locking device comprising:

a conventional cable lock formed from a first flexible steel cable having a first end forming a lockable insertion end and a second end forming an attachment end, said lockable insertion end having a transversly placed aperture receptive to the shank of a padlock, said attachment end defining a loop formed by said first flexible steel cable;

a locking member, said locking member defined as a thin steel plate have a first side surface and a second side surface with an aperture extending therethrough, said aperture including a slot extending therefrom along a length of said steel plate, said aperture sized to receive said lockable insertion end of said cable lock;

an attachment cable formed from a second flexible steel cable having a proximal end permanently attached to said steel plate and a distal end extending therefrom with a length of flexible cable therebetween, said distal end of said second flexible cable sized for insertion through said aperture and said second flexible cable sized for placement within said slot;

and a padlock;

wherein said distal end of said attachment cable is wrapped around an item to be locked and inserted into said aperture of said locking member and transversed for placing said second flexible cable in said slot leaving said aperture available for said insertion end of said conventional cable lock, upon placement of said insertion end of said conventional cable lock through said aperture, said insertion end is then available for receipt of said padlock thereby locking said item to whatever said attachment end of said conventional cable lock is secured too.

2. The accessory locking device according to claim 1 wherein said plate has four edges.

3. The accessory locking device according to claim 1 wherein said locking member is a substantially rectangular steel plate.

4. The accessory locking device according to claim 1 wherein said slot is L-shaped.

5. The accessory locking device according to claim 1 wherein said attachment cable has at least one cable crimp located between said distal end and said proximal end, said cable crime sized to inhibit forward movement of said attachment cable when said attachment cable is placed in said slot.

6. The accessory locking device according to claim 1 whereinan end member operates as a handle for grasping the flexible cable and positioning thereof.

7. The accessory locking device according to claim 1 wherein said attachment cable has at least two cable crimps located between said distal end and said proximal end, said cable crimps spaced apart and sized to inhibit forward and rearward movement of said attachment cable when said attachment cable is placed in said slot.

8. An accessory locking device comprising:

a conventional cable lock formed from a first flexible steel cable having a first end forming a lockable insertion end and a second end formind an attachment end, said-lockable insertion end having a transverslv placed aperture receptive to the shank of a padlock, said attachment end defining a loop formed by said first flexible steel cable;

a locking member, said locking member defined as a thin steel plate have a first side surface and a second side surface with an aperture extending therethrough, said aperture including an L-shaped slot extending therefrom along a length of said steel plate, said aperture sized to receive said lockable insertion end of said cable lock;

an attachment cable formed from a flexible steel cable having a proximal end permanently attached to said steel plate and a distal end extending therefrom with a length of flexible cable therebetween, said distal end of said cable sized for insertion through said aperture and said second flexible cable sized for placement within said slot;

at least one swaged fitting located along the length of said second flexible cable;

and a padlock;

wherein said distal end of said attachment cable is wrapped around an item to be locked and inserted into said aperture of said locking member and transversed for placing said second flexible cable in said slot wherein said swaged fitting engages a side surface of said locking member leaving said aperture available for said insertion end of said conventional cable lock, upon placement of said insertion end of said conventional cable lock through said aperture, said insertion end is then available for receipt of said padlock thereby locking said item to whatever said attachment end of said conventional cable lock is secured too.

9. The accessory locking device according to claim 8, wherein said steel plate has four edges.

10. The accessory locking device according to claim 8 wherein said locking member is a substantially rectangular steel plate.

11. The accessory locking device according to claim 8 wherein said attachment cable has at least two cable crimps located between said distal end and said proximal end, said cable crimps spaced apart and sized to inhibit forward and rearward movement of said attachement cable when said attachment cable is placed in said slot.

* * * * *

UNITED STATES PATENT AND TRADEMARK OFFICE

CERTIFICATE OF CORRECTION

PATENT NO. : 6,829,916 B1
DATED : December 14, 2004
INVENTOR(S) : Devecki

It is certified that error appears in the above-identified patent and that said Letters Patent is hereby corrected as shown below:

In the drawings, the attached drawing Figures 1-5 should replace drawing Figures 1-5.

Signed and Sealed this

Fifth Day of April, 2005

JON W. DUDAS
*Director of the United States Patent and Trademark Office*